United States Patent [19]

Torrey et al.

[11] 4,409,007

[45] Oct. 11, 1983

[54] PRECIPITATOR RAPPER

[75] Inventors: Rodney J. Torrey, Erie, Pa.; Dennis Astemborski, Tucson, Ariz.; Marshall A. Carner, Fairview; Gerald D. Rose, Erie, both of Pa.

[73] Assignee: Eriez Manufacturing Company, Erie, Pa.

[21] Appl. No.: 312,909

[22] Filed: Oct. 19, 1981

[51] Int. Cl.[3] ..... B03C 3/76

[52] U.S. Cl. ..... 55/112; 173/117; 335/255

[58] Field of Search ..... 55/112, 300; 335/255, 335/256, 258, 268; 173/117

[56] References Cited

U.S. PATENT DOCUMENTS

| | | | |
|---|---|---|---|
| 2,344,178 | 3/1944 | Sparrow | 335/256 X |
| 2,435,817 | 2/1948 | Boynton et al. | 335/256 |
| 2,777,535 | 1/1957 | Hull | 55/112 |
| 2,922,006 | 1/1960 | Debrey | 335/255 X |
| 2,967,302 | 1/1961 | Loveless | 173/117 |
| 3,436,121 | 4/1969 | Cunningham | 173/117 X |
| 3,504,480 | 4/1970 | Copcutt et al. | 55/112 |
| 3,543,906 | 12/1970 | Hladky | 335/256 X |
| 4,305,736 | 12/1981 | Kahl et al. | 55/112 |

FOREIGN PATENT DOCUMENTS

| | | | |
|---|---|---|---|
| 593803 | 3/1960 | Canada | 55/112 |

*Primary Examiner*—Kathleen J. Prunner
*Attorney, Agent, or Firm*—Charles L. Lovercheck; Wayne L. Lovercheck; Dale R. Lovercheck

[57] ABSTRACT

A Precipitator Rapper is disclosed having a non-magnetic tube adjustably attached to a solenoid and a hammer extending through the solenoid and through the tube. The solenoid is adjustable toward and away from the precipitator and the tube has a removal cap on the end remote from the precipitator that can be removed so that an accurate measurement can be made from the hammer to the outer end of the tube. This enables a person to accurately adjust the hammer relative to the tube.

9 Claims, 4 Drawing Figures

PRECIPITATOR RAPPER

BACKGROUND OF INVENTION

The Precipitator Rapper has been designed to deliver the impulse force required to dislodge accumulated particulates from the collecting plates of an electrostatic precipitation system.

Operation of the rapper is governed by a solid state controller which will precisely set the magnitude and duty cycle of rapping. This reduces considerably the energy consumed as compared to previously available rappers. This savings in operating cost combined with the flexibility, durability and reliability of the rapper, plus its economical price, make this device the logical choice for electrostatic precipitator systems.

The concept and principle of operation of this device is based on simplicity and efficiency. This has led to the development of a product that is easily installed and fully adjustable. Maintenance is negligible.

There are numerous designs for subject rappers which appear to be similar but are not. The unit described herein is the simple lift-drop type which operates as a solenoid to lift a steel hammer of some specified size and allow it to drop. The weight of the hammer, which is dropped a specific distance, creates the foot pounds imparted to the structure and its members, which are to be freed of collected dust. This principle has been known for many dozens of years and no attempt is being made to change it.

All products of this type encompass a coil, a rigid inner dielectric tube, an outer steel or aluminum housing with suitable lower attachment flange and upper enclosing cap. A round steel bar acts as a hammer. The only adjustable feature to current models is permitted by use of threaded rods or spacers which allow the entire rapper to be raised or lowered with respect to the position of the hammer; that is, the hammer is free and rests on the structure it will rap. When the coil is energized, the hammer is lifted. De-energizing the coil allows it (the hammer) to drop. By adjusting the threaded rod, the vertical location of the entire rapper may be changed in order to change location of the coil allowing the lift of the hammer to be adjusted.

In making this adjustment, all components of the rapper change position as a unit except the relative position of the hammer. This creates several problems. First, if the entire assembly is raised, a gap is opened between the top of the precipitator and the rapper. This permits contaminants to enter and heat losses to occur. Second, when the rapper is built as a unit, the coil maintains a fixed position relative to the other components of the rapper. Once the outer shell of the rapper is welded together, it is not practical or feasible to change these relative positions.

GENERAL DESCRIPTION OF INVENTION

The new precipitator rapper is a basically simple device. It consists of a coil enclosed in epoxy forming a triangular shape; the heavy duty power cord exits on the underside of the coil. The coil is supported by three ⅜ inch-diameter all-thread rods threaded along their entire lengths. A non-metallic guide tube passes through the center of the coil and is secured by a stainless steel retainer plate. A cap seals the top of the guide tube.

A round low-carbon steel plunger, or hammer, for example, 2¼" in diameter by 18" long and weighing 20 pounds, is enclosed in the guide tube.

The rapper design being proposed does not have the limitations described in earlier models, but offers adjustable features to offset these limitations. These adjustable features include the capability for varying force and performance characteristics. The features are illustrated in FIG. 1.

A second feature of this device, coupled with the function of its controller, is that a second coil may be mounted above the initial (See FIG. 4) coil, physically spaced by adjustment and timed by the controller to increase the height to which the hammer may be raised. Being an adjustable feature, this permits a broader range of hammer heights available and thus a broader range of output force by dropping the hammer from these variously different selected heights.

The object of raising or lowering the entire unit is to increase or decrease the foot pounds of output energy. This is done by the energized coil raising the hammer to a greater or lesser height. If by adjustment, raising the entire unit extracts the coil too far from the hammer, the electromagnetic attractive energy will not be sufficient to raise the hammer.

OBJECTS OF THE INVENTION

It is an object of the invention to provide an improved low cost precipitator rapper.

Another object of the invention is to provide an improved precipitator rapper having an easily adjustable coil position.

With the above and other objects in view, the present invention consists of the combination and arrangement of parts hereinafter more fully described, illustrated in the accompanying drawing and more particularly set forth in the appended claims, it being understood that changes may be made in the form, size, proportions, and minor details of construction without departing from the spirit or sacrificing any of the advantages of the invention.

GENERAL DESCRIPTION OF DRAWING

The drawing (FIG. 1) shows a longitudinal cross-section view of a precipitator rapper according to the invention.

The drawing (FIG. 2) shows another embodiment of the invention.

The drawing (FIG. 3) is a top view of FIG. 2.

The drawing (FIG. 4) shows a partial cross sectional view of another embodiment of the invention.

DETAILED DESCRIPTION OF DRAWING

Figure 1:
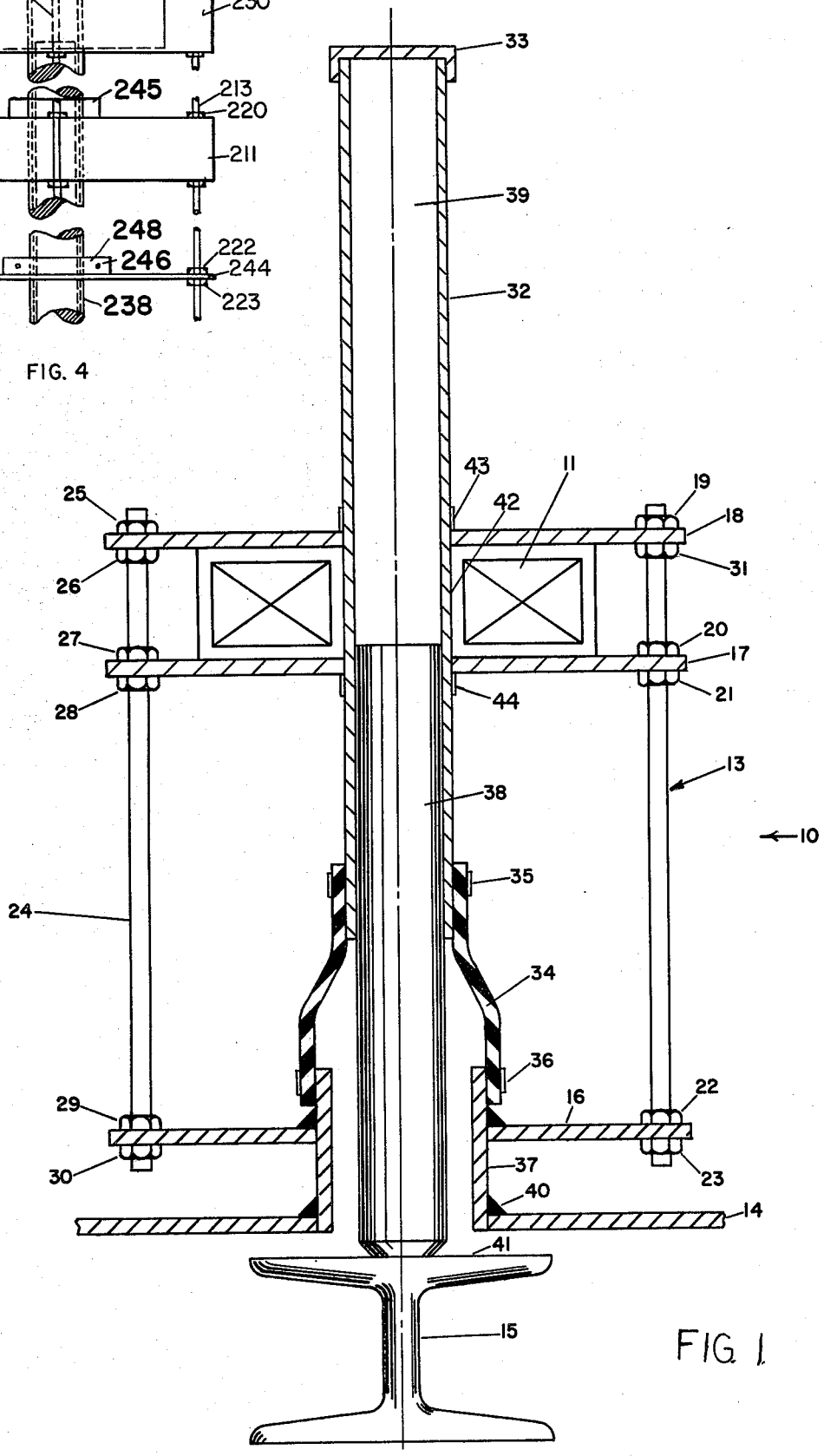

Now with more particular reference to the drawing, FIG. 1, the precipitator rapper shown generally at 10 is for impacting a precipitator to dislodge foreign material therefrom. The rapper 10 has a frame 13 with means for supporting the frame 13 on a precipitator top 14 having an I-beam frame 15 for supporting the various plates commonly used in precipitators of a type that are likely to accumulate foreign material. Hammer 38 is adapted to strike surface 41 of the I-beam frame 15 of a precipitator.

A solenoid 11 having a central hole 42 is supported on the upper ends of rods 24 which are rigidly held in place on the first plate 16 which is rigidly attached to the upperwardly extending tubular member 37 on the precipitator and welded to the precipitator plate 14 at 40 thereby providing means for supporting the rapper frame on the precipitator. Rods 24 are held in place in the plate 16 as well as in the plates 17 and 18 by double nuts 22, 23, 29, and 30 in connection with plate 16 and by nuts 19, 31, 20, 21, 25, 26, 27, and 28 with regard to plates 17 and 18.

The solenoid 11 is sandwiched between plates 17 and 18 and the tube 32 is held in position relative to the plates 17 and 18 by the upper clamp 43 and the lower clamp 44.

The boot 34 made of flexible material is clamped to the tubular member 37 by means of clamp 36 and clamped to the tube 32 by means of clamp 35. Tube 32 has a bore 39 in which the hammer 38 reciprocates. The boot 34 is made of a flexible material such as rubber or the like. It is not necessary to adjust the tube 32 up and down relative to the solenoid 11. The solenoid itself can be adjusted up and down by means of the double nuts 19, 20, 21, 22, 23, 25, 26, 27, 28, 29, 30, and 31 thus controlling the length of blow of hammer 38. Access is provided to the inside of the tube by removing cap 33 which the operator can remove to measure the position of the solenoid 11 relative to the upper surface of the hammer 38 so that the solenoid can be adjusted up or down by adjusting the nuts 22, 23, 29 and 30 up or down.

Figure 3:
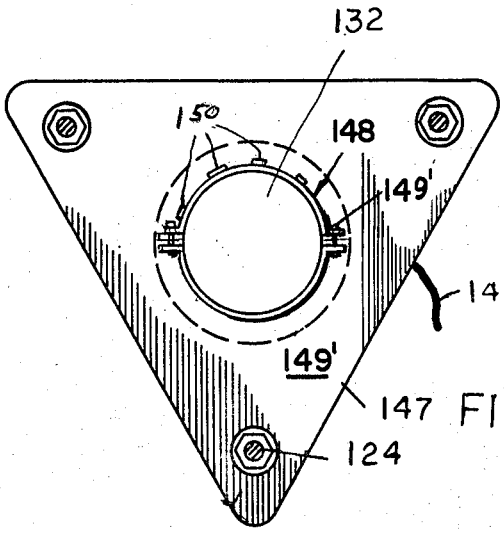
Figure 2:
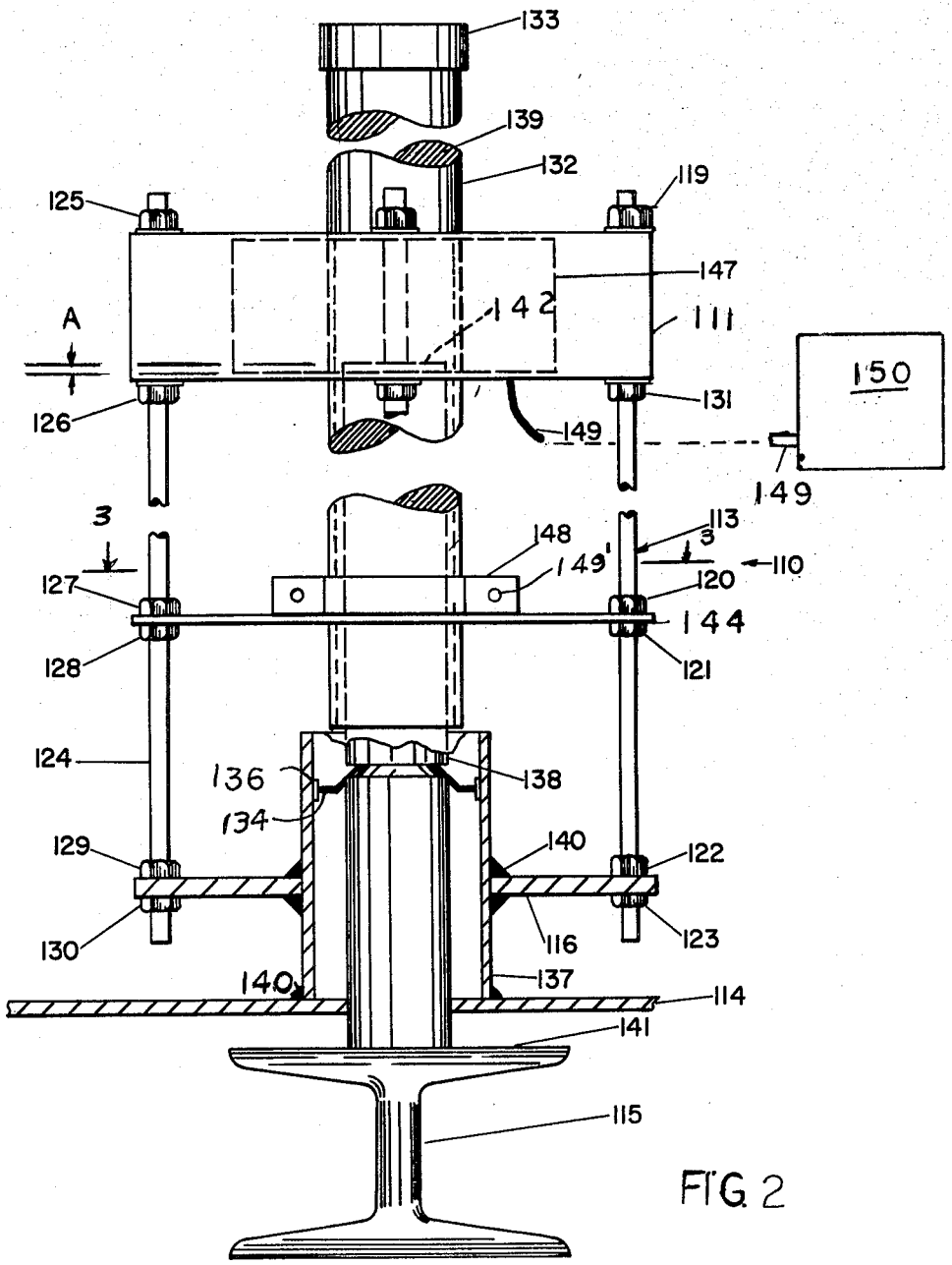

In the embodiment of the invention shown in FIGS. 2 and 3, the material that encloses the solenoid 147 is shown in triangular form while the solenoid itself is indicated as a coil inside the material which encloses it.

Figure 4:
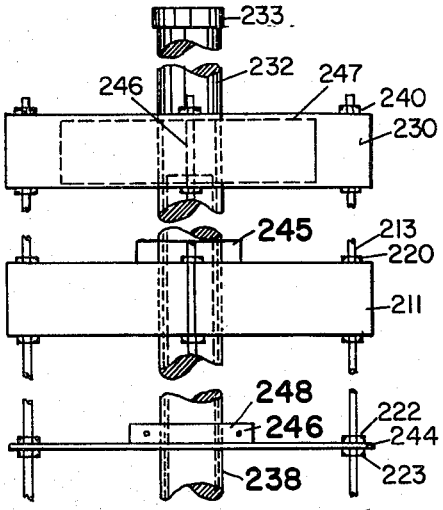

In the embodiment of the invention shown in FIG. 4, a second solenoid coil 230 is supported above the first solenoid coil 211. It will be noted that the rods 124 which support the solenoid 147 in FIG. 2 are three in number and that the material in which the coil 147 is enclosed is triangular. The material in which the coil 147 is enclosed is an electrical insulation material.

In the embodiment of the invention shown in FIGS. 2 and 3, the rapper 110 has a frame 113 with means 114 for supporting the frame 113 on a precipitator top 114 having an I-beam frame 115 for supporting the various plates commonly used in precipitators of a type that are likely to accumulate particulate material. Hammer 138 is adapted to strike surface 141 of the I-beam frame 115.

A solenoid 147 having a central hole is supported on the upper ends of rods 124 which are rigidly held in place on the first plate 116 which is rigidly attached to the upwardly extending tubular member 137. The tubular member 137 is welded to the precipitator plate 114 by weld 140. Rods 124 are held in place in the plate 116 as well as in the material that encloses solenoid 147 by double nuts 122, 123, 129, and 130 in connection with plate 116 and by nuts 119, 131, 125, and 126 with regard to the solenoid 147.

The solenoid 147 is held by enclosing material 111 which may be adjusted up or down by nuts 119, 131, 125 and 126 and the tube 132 is held in position relative to the solenoid by the clamp 148. Tube 132 has a cap 133 closing its upper end providing access to the inside 139 of tube 132 whereby the position of hammer 138 can be determined. The clamp 148 is welded to plate 144. Clamp 148 is a two piece clamp of a familiar type. The clamp parts are held together by bolts 149'. When bolts 149' are loosened tube 132 can be pulled out of solenoid 147 completely and solenoid 147 can be adjusted up or down by nuts 119, 131, 125 and 126 so that the upper edge 142 of the hammber 138 is precisely located relative to the lower end of the coil in solenoid 147. Solenoid 147 is actuated by controller 150 via line 149.

It is extremely important that the top edge of the hammer 138 be precisely located relative to the solenoid since a heavy transient current will flow in the solenoid coil when the power is first turned onto solenoid 147. A proper dimension A for the top of the hammer to the bottom of the coil has been found to be three-eighths of an inch.

The boot 134 made of flexible material is clamped to the inside periphery of tubular member 137 by means of clamp 136 and forms a seal with hammer 138. The boot 134 is made of flexible material such as rubber or the like. The solenoid itself can be adjusted up and down by means of the double nuts 119, 120, 121, 122, 123, 125, 126, 127, 128, 129, 130, and 131, thus controlling the length of blow of hammer 138.

In the embodiment of the invention shown in FIG. 4, a partial view of an embodiment similar to FIG. 2 is shown, but a second coil 230 shown above the coil 211 is similar to the solenoid 147 shown in the embodiment of FIG. 2. The solenoids 211 and 230 are held in place by means of nuts 240 and 220 that engage the rods 213. Nuts 222 and 223 hold the rods 213 in plate 244 and can be used to adjust the positions of the coils 211 and 230. The first coil and second coil can be actuated through the controller 250 which will first actuate coil 211 to lift the hammer 238. On each cycle of the hammer when controller 250 is energized it will first energize solenoid 211 which will pull the hammer up until it centers in the solenoid 211. Then solenoid 247 will be energized by controller 250 and it will pull the hammer up an additional height until it centers in solenoid 230. By physically spacing the second coil above the first, and timing the solenoids by means of the controllers to increase the height which the hammer may be raised, a broader range of hammer heights are available and thus a broader range of output force is available by dropping the hammer from these different selected heights.

If the single coil is adjusted too far up, the electromagnetic attracted energy would not be sufficient to raise the hammer.

The lower clamp 248 is made in two parts. One part is welded to the stainless steel stabilizer plate 244, the other half of the clamp is connected to the first half by means of bolts 246. Thus, the bolts can be loosened and the tube 232 lifted to any desired height. The upper clamp 245 is similar to clamp 248.

The foregoing specification sets forth the invention in its preferred practical forms but the structures shown are capable of modification within a range of equivalents without departing from the invention which is to be understood as being as broadly novel as is commensurate with the appended claims.

The embodiments of the invention in which an exclusive property or privilege is claimed are defined as follows:

1. In combination, an electrostatic precipitator having a precipitator frame and a rapper to impact said precipitator frame, said rapper comprising a rapper frame and a first support means for supporting said rapper frame on a top wall of said precipitator, said rapper frame comprising vertically spaced plates having openings therein and means supporting said plates in vertically spaced relation, a first solenoid having an opening therein, said solenoid being supported by and sandwiched between said plates with said solenoid opening being in alignment with said openings in said plates, a vertically disposed non-magnetic tube extending through said opening in said solenoid and through said openings in said plates, means for holding said plates in position on said tube, a hammer reciprocably received in said tube, an opening in said top wall of said precipitator and aligned with said opening in said solenoid and said openings in said plates so as to enable said hammer to impact said frame of said precipitator, a cap on the upper end of said tube providing access to the upper end of said hammer inside said tube whereby the position of said hammer relative to said tube can be determined, said means for holding said plates in position comprising upper and lower clamps on said tube whereby said tube can be slid up or down relative to said solenoid.

2. The combination recited in claim 1 wherein a second solenoid is supported on said upper frame, and means is provided to adjust said second solenoid up and down relative to said first solenoid.

3. In combination an electrostatic precipitator having a precipitator frame and a rapper arranged to impact said precipitator frame, said rapper having a rapper frame and means supporting said rapper on a top wall of said precipitator, said rapper frame comprising vertically spaced plates each having an opening therein and means supporting said plates in vertically spaced relation, a first solenoid having an opening therein, said solenoid being supported by said plates of said rapper frame, a vertically disposed non-magnetic tube extending through said opening in said solenoid and through said openings in said plates, a hammer reciprocably received in said tube, an opening in said top wall of said precipitator and aligned with said opening in said solenoid and said openings in said plates so as to enable said hammer to impact said frame of said precipitator, a cap on the upper end of said tube providing access to the upper end of said hammer inside said tube whereby the position of said hammer relative to said tube can be determined, said tube being held in position relative to said plates by clamp means supporting said tube on said plates, said clamp means having releasable means thereon whereby said tube can be removed from said solenoid and said plates providing access to said hammer whereby the position of said solenoid can be determined with respect to said hammer.

4. The combination recited in claim 3 wherein said means supporting said plates comprises, circumferentially spaced rods adjustably attached to said spaced plates and means on said rods to hold said plates in precise spaced relation to each other.

5. The combination recited in claim 4 wherein said rods are three in number.

6. The combination recited in claim 3 wherein said solenoid comprises a coil enclosed in an electrical insulating material.

7. Combination recited in claim 3 wherein said clamp means comprises two separable parts encircling said tube and said releasable means comprises bolt means clamping said parts into frictional engagement with said tube.

8. The combination recited in claim 7 wherein a second solenoid is supported above said first solenoid and a controller is connected to said solenoids.

9. In combination, an electrostatic precipitator having a precipitator frame and a rapper arranged to impact said precipitator frame, said rapper having a rapper frame and means adapted to support said rapper frame on a top wall on said precipitator, said rapper frame comprising vertically spaced plates each having an opening therein and support means supporting said plates in vertically spaced relation, a solenoid having an opening therein, said solenoid being supported by said plates of said rapper frame, a vertically disposed non-magnetic tube extending through said opening in said solenoid and through said openings in said plates, a hammer reciprocably received in said tube, an opening in said top wall of said precipitator and aligned with said opening in said solenoid and said openings in said plates so as to enable said hammer to impact said frame of said precipitator, a cap on the upper end of said tube providing access to the upper end of said hammer inside said tube whereby the position of said hammer relative to said tube can be determined, said cap providing means for enabling adjustment of said solenoid precisely to the required position relative to said hammer relative to said tube thereby controlling the excursion of said solenoid and protecting said solenoid against overcurrent.

* * * * *